US007013266B1

(12) United States Patent
Berger

(10) Patent No.: US 7,013,266 B1
(45) Date of Patent: Mar. 14, 2006

(54) METHOD FOR DETERMINING SPEECH QUALITY BY COMPARISON OF SIGNAL PROPERTIES

(75) Inventor: Jens Berger, Berlin (DE)

(73) Assignee: Deutsche Telekom AG, Bonn (DE)

( * ) Notice: Subject to any disclaimer, the term of this patent is extended or adjusted under 35 U.S.C. 154(b) by 0 days.

(21) Appl. No.: 09/530,389

(22) PCT Filed: Aug. 14, 1999

(86) PCT No.: PCT/EP99/05972

§ 371 (c)(1),
(2), (4) Date: Apr. 4, 2001

(87) PCT Pub. No.: WO00/13173

PCT Pub. Date: Mar. 9, 2000

(30) Foreign Application Priority Data

Aug. 27, 1998 (DE) ..... 198 40 548

(51) Int. Cl.
*G10L 11/00* (2006.01)

(52) U.S. Cl. ..... 704/203; 704/206; 704/228; 704/243

(58) Field of Classification Search ..... 704/203, 704/206, 209, 228, 243
See application file for complete search history.

(56) References Cited

U.S. PATENT DOCUMENTS

| | | | | |
|---|---|---|---|---|
| 4,860,360 A | * | 8/1989 | Boggs | 704/233 |
| 5,621,854 A | | 4/1997 | Hollier | |
| 6,064,966 A | * | 5/2000 | Beerends | 704/500 |

FOREIGN PATENT DOCUMENTS

| | | | |
|---|---|---|---|
| DE | 37 08 002 | 9/1988 | |
| EP | 0 727 767 | 8/1996 | |
| EP | 0 809 236 | 11/1997 | |
| WO | WO 96/28952 | * 9/1996 | 704/500 |

OTHER PUBLICATIONS

J.G. Beerends et al., "A Perceptual Speech–Quality Measure Based on a Psychoacoustic Sound Representation," J. Audio Eng. Soc., vol. 42, No. 3, Mar. 1994, pp. 115–123.
S. Wang et al., "Auditory Distortion Measure for Speech Coding," IEEE Proc. Int. Conf. Acoust., Speech and Signal Processing, May 14–17, 1991, pp. 493–496.
U. Halka et al., "A New Approach to Objective Quality–Measures based on Attribute–Matching," Speech Communication, vol. 11, 1992, pp. 15–30.
"Objective Quality Measurement of Telephone–Band (300–3400 Hz) Speech Codecs," ITU–T Recommendation p. 861, revised (1998).

* cited by examiner

*Primary Examiner*—Richemond Dorvil
*Assistant Examiner*—Donald L. Storm
(74) *Attorney, Agent, or Firm*—Kenyon & Kenyon

(57) ABSTRACT

In a method for determining speech quality using an objective measure, in order to enhance prediction reliability of the evaluated quality parameters, distortions of the mean spectral envelope are extensively corrected with a weighting function $W_T(f)$ before comparing spectral properties. Additionally, the fixed band limits for integration of spectral power density are suppressed and other band limits are searched for instead in a predetermined optimization area in which the resulting spectral intensity representations of the voice signal to be evaluated and the reference voice signal have maximum similarity. The solutions described can supplement known methods and can be incorporated into their structures.

7 Claims, 4 Drawing Sheets

METHOD FOR DETERMINING SPEECH QUALITY BY COMPARISON OF SIGNAL PROPERTIES

FIELD OF THE INVENTION

The present invention relates to a method for determining speech quality using objective measures, in which characteristic values for determining speech quality are derived by comparing properties of a speech signal to be assessed to properties of a reference speech signal, or undisturbed signal.

RELATED TECHNOLOGY

The quality of speech signals may be determined through auditory ("subjective") tests by test persons.

Objective methods for determining speech quality ascertain, with the aid of suitable calculation methods, characteristic values from the properties of the speech signal to be assessed, the characteristic values describing the speech quality of the speech signal to be assessed, without having to resort to the judgments of test persons.

The calculated characteristic values and the underlying method for determining speech quality using objective measures are regarded as acknowledged if a high correlation with the results of auditory reference tests is achieved. Consequently, the speech-quality values obtained by auditory tests represent the target values which are to be achieved by objective methods.

Available methods for determining speech quality using objective measures are based on a comparison of a reference speech signal to the speech signal to be assessed. In this context, the reference speech signal and the speech signal to be assessed are segmented into short time segments. The spectral properties of the two signals are compared in these segments.

Various approaches and models are used to calculate the spectral short-time properties. Generally, the signal intensity is calculated in frequency bands whose width becomes greater with increasing mid-frequency. Examples of such frequency bands are the known third-octave bands or frequency groups according to reference "Psychoakustik" ["Psychoacoustics"], by E. Zwicker, Berlin: Springer Publishing House, 1982.

The spectral intensity representation thus calculated for each time segment considered can be viewed as a series of numerical values, in which the number of individual values corresponds to the number of frequency bands used, the numerical values themselves represent the calculated intensity values, and a consecutive index of the frequency bands describes the sequence of the numerical values.

In available methods for determining speech quality using objective measures, the limits of the frequency bands utilized are kept constant on the frequency axis.

In each time segment under consideration, the calculated intensities of the speech signal to be assessed and of the reference speech signal are compared to each other in each band. The difference of both values, or the similarity of the two resulting spectral intensity representations, constitutes the basis for the calculation of a quality value (see FIG. 1).

Such methods were developed for the qualitative assessment of speech in telephone applications. Some examples are illustrated in the following references: "*A perceptual speech-quality measure based on a psychacoustic sound representation*," by J. G. Beerends and J. A. Stemerdink, J. Audio Eng. Soc. 42(1994)3, pp. 115–123; "*Auditory distortion measure for speech coding*," by S. Wang, A. Sekey, and A.

Gersho, IEEE Proc. Int. Conf. acoust., speech and signal processing (1991), pp.493–496; and ITU-T standard P.861, "*Objective quality measurement of telephone-band speech codecs*," ITU-T Rec. P.861, Geneva 1996.

The use of available methods for determining speech quality using objective measures fails with respect to the reliability of the calculated quality values for certain signal properties to be assessed. Presently available methods furnish only unreliable quality values in particular when the speech signal to be assessed is impaired, such as in the case of impairments caused by speech coding methods with low bit rates or combinations of different disturbances.

In such cases, the presently available methods have the disadvantage that, given a comparison between the speech signal to be assessed and a reference speech signal, the quality characteristic value to be calculated includes differences between the two signal segments in the selected representation plane which either do not lead or scarcely lead to a qualitative impairment, not even one which is perceptible in the auditory test.

Within the framework of the transmission of speech in telephone applications that is being discussed here, frequency-band limitations and spectral deformations of the speech signal to be assessed (caused, for example, by filter properties of the telephone device or of the transmission channel) contribute only to a limited extent to a perceived qualitative impairment.

To partially prevent such deficiencies, an attempt is made in a different approach to compensate for the linear distortions (frequency response) by a correction filter or a power-transmission function. See, e.g., "*A new approach to objective quality-measures based on attribute-matching*", by U. Halka and U. Heute, Speech communication, 11(1992)1, pp.15–30. However, the use of this method is disadvantageous in the case of nonlinear and time-invariant transmission, since the compensation function thus calculated no longer exclusively describes the spectral deformations of the signal to be assessed.

In available methods, displacements of spectral short-time maxima ("formant displacements") in the signal under test in relation to the reference speech signal caused, for example, by coding systems with low bit rates, lead to large differences in the spectral intensity representations and therefore have a great influence on the calculated quality value. However, investigations have revealed that, in an auditory speech-quality test, these displacements of spectral short-time maxima have only a limited influence on the quality judgment.

SUMMARY OF THE INVENTION

An object of the invention is to reduce the influence of spectral limitations and deformations of the speech signal to be assessed, as well as the influence of displacements of spectral short-time maxima, prior to comparing the spectral properties of a signal to be tested to a reference speech signal, and prior to the calculation of a quality value using objective methods.

In contrast to available approaches, according to the present invention, a spectral weighting function is generated which is based on mean spectral envelopes, e.g., the mean spectral power density, of the speech signal to be assessed and the reference speech signal. This permits the use of the method in the case of nonlinear and time-variant transmission as well.

The spectral weighting function is calculated from the quotients of the given values of the mean spectral power density of the signal to be assessed $Phi_y(f)$ and that of the input signal of the transmission system $Phi_x(f)$, such that the weighting function can be described via $$W_T(f)=a(f)\cdot(Phi_y(f)/Phi_x(f)).$$

The assessment function a(f) can weight the weighting function $W_T(f)$ differently over the range of effect, being constant at 1 in the simplest case.

The spectral weighting function $W_T(f)$ thus calculated brings the mean spectral envelopes of the speech signal to be assessed and the reference speech signal closer to each other, so that differences of the two spectral envelopes are included only to a reduced extent in the calculated quality value.

The spectral weighting function $W_T(f)$ can be applied, firstly, to the reference speech signal. In this context, the reference speech signal, in its mean spectral power density, is made to approximate the signal to be assessed (FIG. 2*a*).

Secondly, the spectral weighting function can be applied, inverted, to the signal to be assessed. The distortion of the latter is thereby eliminated and, with regard to its mean spectral power density, it is made to approximate the reference speech signal (FIG. 2*b*).

A further aspect of the present invention relates to the correction of displacements of spectral short-time maxima which are caused by the transmission systems.

The intensity is integrated for each time segment in frequency bands. The result is a series of intensity values for each spectral representation of a signal segment, each individual value representing the intensity in a frequency band. In this connection, the displacements of spectral short-time maxima may lead to different calculated intensities in the frequency bands of the reference speech signal and the speech signal to be assessed.

These differences in the spectral intensity representations—caused by displacements of spectral short-time maxima—can be reduced by a variable arrangement of the frequency bands on the frequency axis. In contrast to the constant band limits in known methods, the band limits are displaced on the frequency axis. However, the number of frequency bands and their index remain constant. In an optimization loop, those band limits are then accepted at which the two resulting spectral representations of speech signal to be assessed and reference speech signal exhibit maximum similarity, or whose difference is minimal. This optimization is carried out for all bands in all time segments under consideration.

The use of variable band limits to calculate the spectral intensity representation is not restricted only to the signal in which the described spectral weighting function $W_T(f)$ is also used, but may also be applied to the other respective signal and even to both signals (see FIGS. 2*a* and 2*b*).

In order to improve the reliability of the calculated quality characteristic values, first of all, deformations of the mean spectral envelopes are largely corrected with a weighting function $W_T(f)$ prior to comparing the spectral properties. Secondly, the fixed band limits for integration of the spectral power density are removed and, instead, within a given optimization range, band limits are sought at which the resulting spectral intensity representations of the speech signal to be assessed and the reference speech signal exhibit maximum similarity.

In some embodiments, prior to calculating the quality characteristic values, there is an integration of the signal intensity for each evaluated short time segment in frequency groups, the limits of the frequency groups being variable on the frequency axis, but the width of the frequency groups remaining constant on the pitch scale. The specific loudness is calculated from the signal intensities in the frequency groups, the limits of those frequency groups being used in which the calculated differences in the specific loudness between the signal to be assessed and the reference speech signal exhibit the smallest difference in the band and time segment under consideration.

In further embodiments, the quality characteristic values is calculated from the similarity of the spectral representations in each time segment under consideration. The similarity representing a correlation coefficient, is averaged over all time segments under consideration, between the spectral representation of the speech signal to be assessed and the spectral representation of the reference speech signal in the respectie time segment. In further embodiments, the weighting function $W_T(f)$ is calculated only from partial regions of the calculated mean spectral envelopes of the speech signal to be assessed and the reference speech signal. Consequently, the differences in mean spectral envelopes between both signals are reduced only in partial spectral regions. In further embodiments, the correlation coefficient between the spectral representation of the speech signal to be assessed and the spectral representation of the reference speech signal in the respective time segment is calculated from only a partial region of the spectral representation. That is, not all calculated spectral values are taken into consideration for the calculation of the quality characteristic value.

DETAILED DESCRIPTION

Figure 3:
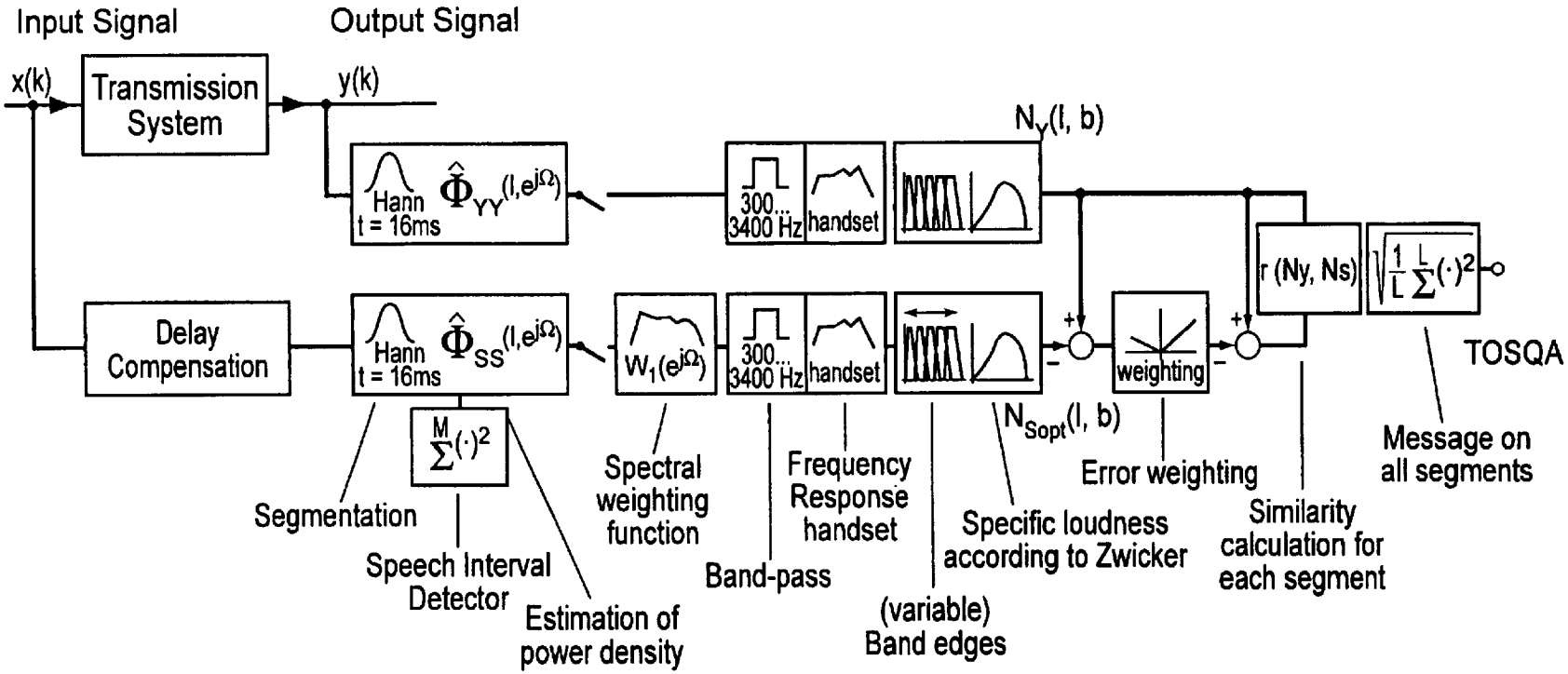
FIG. 3 shows a flow chart depicting a calculation of a Telecommunication Objective Speech Quality Assessment (TOSQA) using a spectral weighting function.

FIG. 3 shows an embodiment according to the present invention, showing a flowchart depicting a calculation of a so-called TOSQA (Telecommunication Objective Speech Quality Assessment). In this case, an expanded preprocessing of the reference speech signal is carried out.

Figure 1:
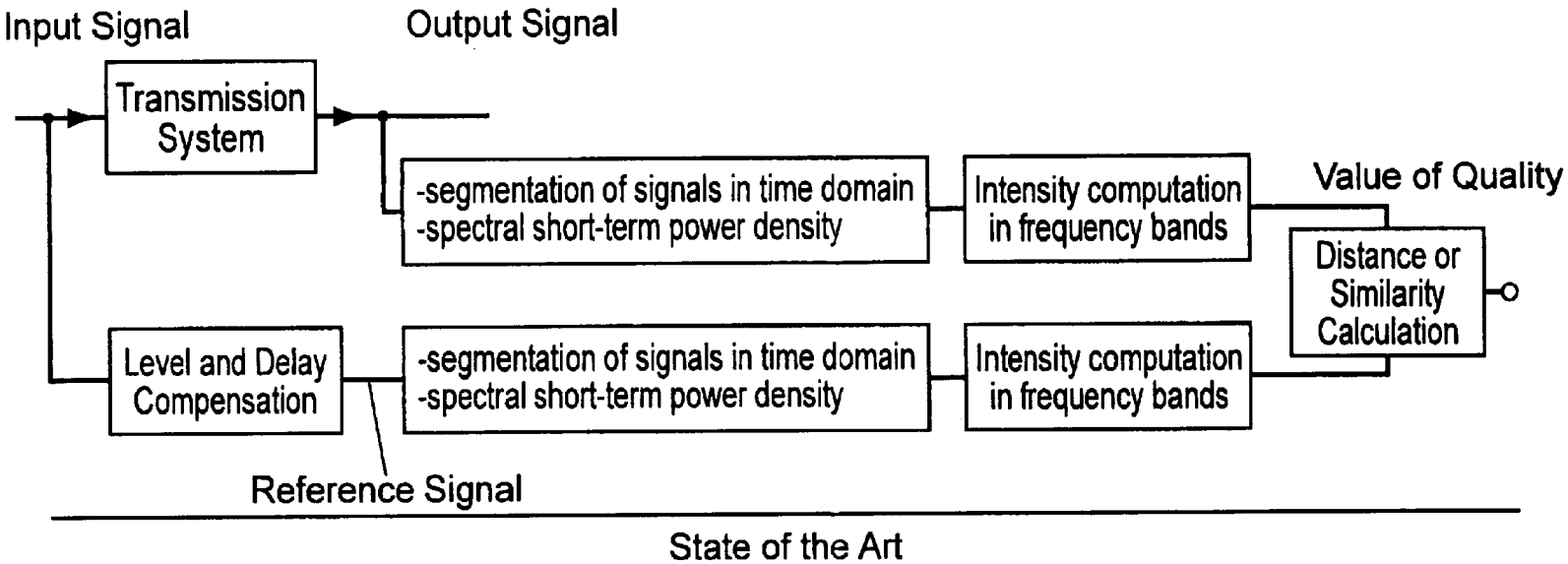
FIG. 1 shows a flow chart depicting a prior art calculation of a quality value.
Figure 2A:
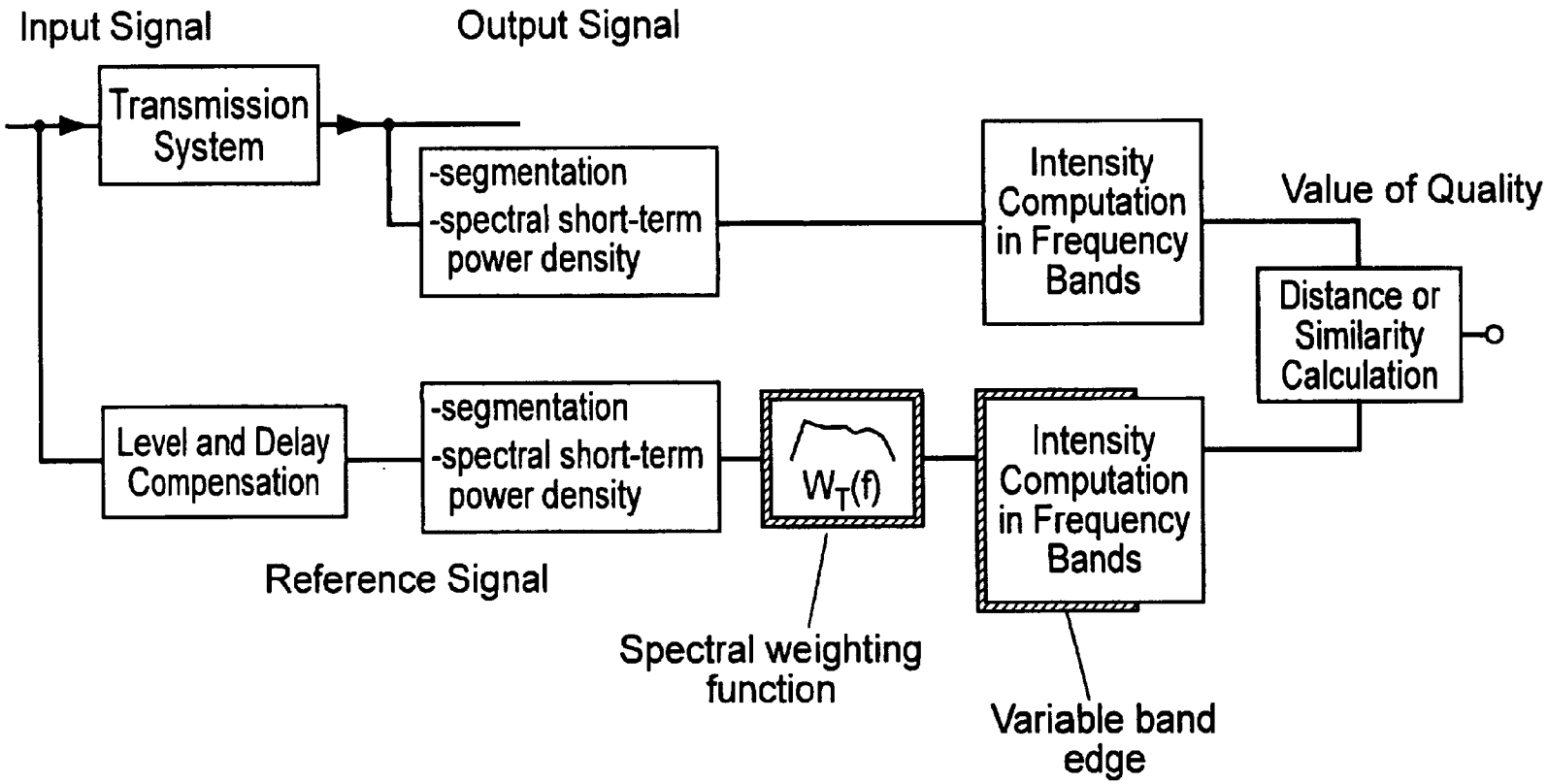
FIG. 2*a* shows a flow chart depicting a calculation of a quality value using a spectral weighting function.
Figure 2B:
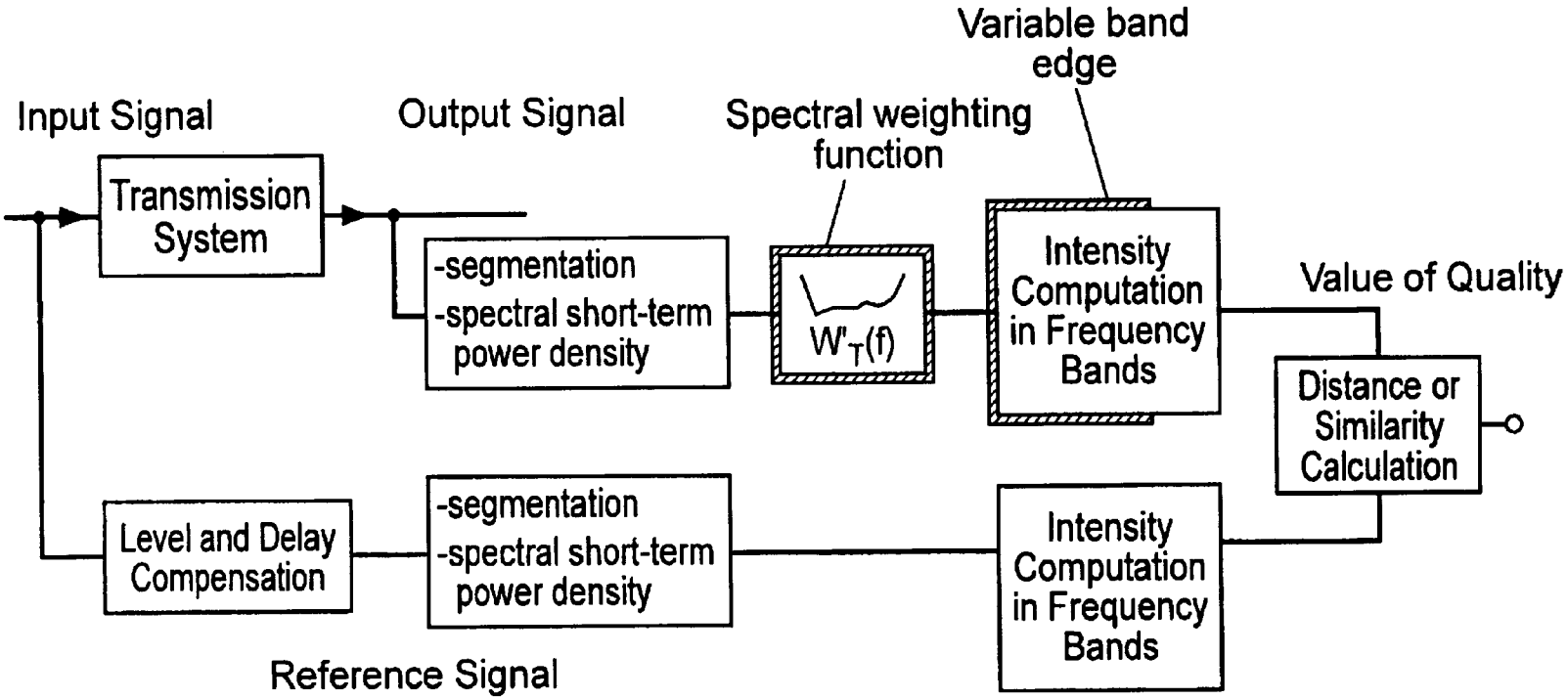
FIG. 2*b* shows a flow chart depicting a calculation of a quality value using an inverted spectral weighting function.

Following the general implementations according to FIGS. 2*a* and 2*b*, but with more specificity, reference speech signal 2 and the speech signal to be assessed 4 are segmented (see blocks 6 and 8, respectively). Speech pauses are detected here by a speech-pause detector (see block 10) and are not included in the quality measure.

Likewise, reference speech signal 2 and speech signal to be assessed 4 are filtered with a 300 . . . 3400 Hz bandpass filter (see blocks 14 and 16, respectively), and there is also filtering to the frequency response of a telephone handset (see blocks 18 and 20, respectively). The weighting function $W_T(f)$ is applied to the reference speech signal before the bandpass filtering (see block 12). The integration of the spectral power density is carried out in frequency groups which represent the basis for the calculation of the specific loudness (see blocks 22 and 24, respectively).

However, the integration in frequency groups is not carried out in fixed frequency-group limits, but with the variable frequency-group limits described in the present invention. The calculated signal powers in the frequency groups thus modified form the basis for the intensity calculation. Use was made here of a model for calculating the specific loudness according to Zwicker, an aurally compensated intensity representation (see "Psychoakustik" ["Psychoacoustics"], by E. Zwicker, Berlin: Springer Publishing House, 1982), which is hereby incorporated by reference herein.

As an addition to the general approach, the calculated loudness patterns are supplemented by an error assessment function (see block 26). The calculated quality value TOSQA is formed via a mean value of the correlation coefficients of the specific loudness for each short time segment under consideration over the number of evaluated speech segments (see block 28).

What is claimed is:

1. A method for determining speech quality using an objective measure, the method comprising:

calculating a speech quality characteristic value by comparing respective spectral short-time properties of an assessed speech signal and of a reference speech signal;

prior to the comparing the respective spectral short-time properties, reducing differences in respective mean spectral envelopes of the assessed speech signal and of the reference speech signal by weighting spectral short-time properties of the assessed speech signal and the reference speech signal in a predetermined number of time segments using a spectral weighting function so as to include differences in the respective mean spectral envelopes in the speech quality characteristic value to a limited extent, the spectral weighting function being calculated from the respective mean spectral envelopes; and calculating a respective intensity value for each of a plurality of frequency bands in a signal segment respectively for the assessed speech signal and the reference speech signal using variable limits for the frequency bands so that a respective difference between each calculated respective intensity of the assessed speech signal and the reference speech signal is reduced, wherein the calculating of the respective intensity value for each of the plurality of frequency bands is performed before the calculating the quality characteristic value and is performed by integrating a respective signal intensity, the width of the frequency bands being constant on a pitch scale and further comprising calculating a respective specific loudness from the respective intensity values in the respective frequency bands, the limits for the frequency bands being selected so that differences in the calculated respective specific loudnesses between the assessed signal and the reference speech signal are a respective minimum in each frequency band in the signal segment.

2. The method as recited in claim 1 wherein the respective difference between each calucalated respective intensity of the assessed speech signal and the reference speech signal is a respective minimuim.

3. The method as recited in claim 1 further comprising, before the reducing the differences in the respective mean spectral envelopes and the calculating the respective intensity, calculating the respective mean spectral envelopes of the assessed speech signal and the reference speech signal in the form of respective mean power density spectra and wherein the calculating of the spectral weighting function is performed using respective quotients of the respective mean power density spectra and wherein a short-time power density spectrum of the reference speech signal is weighted with the spectral weighting function before calculating the speech quality characteristic value.

4. The method as recited in claim 1 further comprising, before the reducing the differences in the respective mean spectral envelopes and the calculating the respective intensity, calculating the respective mean spectral envelopes of the assessed speech signal and the reference speech signal in the form of respective mean power density spectra and wherein the calculating of the weighting function is performed for partial regions of the calculated respective mean spectral envelopes so that the reducing differences in the mean spectral envelopes occurs only in partial spectral regions.

5. A method for determining speech quality using an objective measure, the method comprising:

calculating a speech quality characteristic value by comparing respective spectral short-time properties of an assessed speech signal and of a reference speech signal;

prior to the comparing the respective spectral short-time properties, reducing differences in respective mean spectral envelopes of the assessed speech signal and of the reference speech signal by weighting spectral short-time properties of the assessed speech signal and the reference speech signal in a predetermined number of time segments using a spectral weighting function so as to include differences in the respective mean spectral envelopes in the speech quality characteristic value to a limited extent, the spectral weighting function being calculated from the respective mean spectral envelopes; and calculating a respective intensity value for each of a plurality of frequency bands in a signal segment respectively for the assessed speech signal and the reference speech signal using variable limits for the frequency bands so that a respective difference between each calculated respective intensity of the assessed speech signal and the reference speech signal is reduced, wherein the calculating of the speech quality characteristic value is performed based on a similarity of respective spectral representations of the assessed speech signal and the reference speech signal in a plurality of time segments, the respective similarity representing a respective correlation coefficient between the respective spectral representations of the assessed speech signal and the reference speech signal in a respective time segment of the plurality of time segments averaged over the plurality of time segments.

6. The method as recited in claim 5 wherein the respective spectral representations include the respective spectral short-time properties.

7. The method as recited in claim 5 wherein the respective correlation coefficient is calculated from a subset of the respective spectral representations.

* * * * *